United States Patent [19]

Hall et al.

[11] 4,200,515

[45] Apr. 29, 1980

[54] SINTERED METAL POWDER-COATED ELECTRODES FOR WATER ELECTROLYSIS PREPARED WITH POLYSILICATE-BASED PAINTS

[75] Inventors: Dale E. Hall, Monroe; Ernest L. Huston, Tuxedo Park, both of N.Y.

[73] Assignee: The International Nickel Company, Inc., New York, N.Y.

[21] Appl. No.: 3,856

[22] Filed: Jan. 16, 1979

[51] Int. Cl.[2] ..... C25B 11/04

[52] U.S. Cl. ..... 204/290 R; 204/129

[58] Field of Search ..... 204/290 R, 129

[56] References Cited

U.S. PATENT DOCUMENTS 4,049,841 9/1977 Coker et al. ..... 204/290 R

FOREIGN PATENT DOCUMENTS 921561 3/1963 United Kingdom

*Primary Examiner*—Howard S. Williams

*Attorney, Agent, or Firm*—F. J. Mulligan, Jr.; E. C. MacQueen

[57] ABSTRACT

An electrode for water electrolyzers comprising a steel base having a sintered porous layer of nickel, nickel-iron or iron on the steel base and having an electrochemically formed oxidic layer or hydrogen saturation associated with the sintered layer.

5 Claims, 2 Drawing Figures

SINTERED METAL POWDER-COATED ELECTRODES FOR WATER ELECTROLYSIS PREPARED WITH POLYSILICATE-BASED PAINTS

The present invention is concerned with electrodes for water electrolyzers and, more particularly, with iron-base anodes for water electrolyzers.

BACKGROUND OF THE ART AND PROBLEM

The art of water electrolysis is an old one and is highly developed. Specifically, it has been known for about 80 years that nickel electrodes employed in a strong aqueous solution of KOH are electrochemically catalytic for the release of oxygen from the electrolyte at low overpotentials. Likewise, it is known that low alloy steel is electrochemically catalytic for the release of hydrogen at low hydrogen overpotentials. In sintered form, nickel and steel are excellent electrochemical catalysts. However, sintered nickel or steel structures are expensive, contributing excessively to the capital costs of an electrolyzer. It is desired to provide high surface area, metal faced electrodes which give the electrochemical characteristics of sintered steel or nickel so as to retain the economic operating advantages of sintered metal electrodes while at the same time both incorporating a cheap base structure and being capable of being manufactured at low cost.

DISCOVERY

It has now been discovered that a support structure coated with a thin, metallurgically bonded, porous metal layer is highly advantageous as an electrode structure for water electrolyzers.

OBJECTS

It is an object of the present invention to provide a novel electrode for water electrolysis.

Another object of the present invention is to provide a novel use of an electrode prestructure as a water electrolysis electrode.

Figure 1:
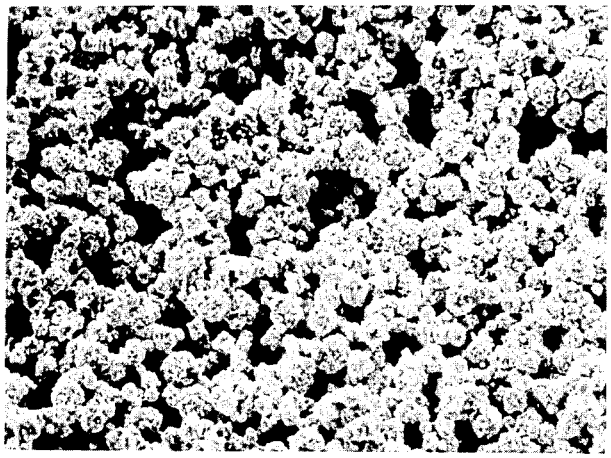
Figure 2:
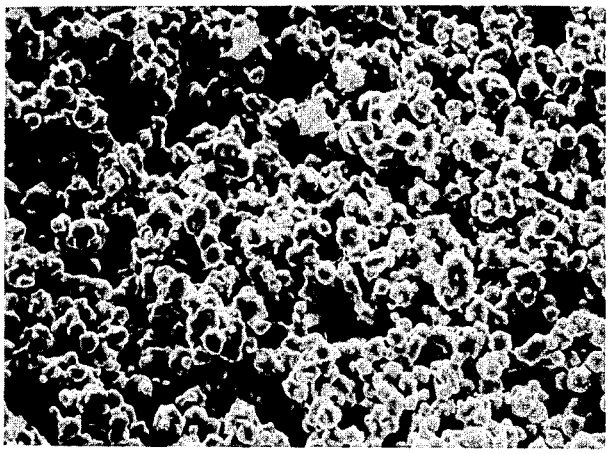

These and other objects will become apparent from the following description taken in conjunction with the drawing in which FIG. 1 is a scanning electron microscopic view of an anode of the present invention; and FIG. 2 is a scanning electron microscopic view of a cathode of the present invention.

DESCRIPTION OF THE INVENTION

The present invention contemplates the use of an electrode precursor structure particularly adapted for use in water electrolyzers having an aqueous potassium or sodium hydroxide electrolyte. The electrode precursor structure has an electroconductive base or support surface bearing a porous, metallurgically bonded layer of metal adhered to the support surface. In the usual case, the support surface is metallic and the porous layer is sintered to the base. In the most usual and advantageous case the support surface is mild steel (alloy of iron and carbon). The metal of the porous layer is, for cathodic purposes, selected from the group of nickel, iron, nickel-iron alloys and iron-carbon alloys. When the electrode is an anode, the metal of the porous layer is either nickel or a nickel-iron alloy containing more than about 10% nickel.

ANODES

The more advantageous of the two types of electrodes in accordance with the present invention is the anode. The anode of the present invention has a layer of electrolytically produced oxide of metal of the porous layer on external and internal surfaces of the porous layer. (Internal surfaces are surface beyond line of sight from the external surface). This metal oxide layer begins to form substantially immediately once the electrode is made anodic in an aqueous alkaline electrolyte and continues to grow and change with time of use as an anode. Overpotential measurements indicate that over the range of 1 to 400 mA/cm$^2$ anode current density, at a temperature of about 80° C. in 30% (by weight) KOH in water, anodes of the present invention exhibit equally good or lower overpotentials when compared to commonly used competitive materials wnhich are more expensive.

Steel based electrodes of the present invention have been made with porous nickel or nickel-iron alloy layers about 25 to 275 micrometers (μm) thick with the preferred and advantageous range of thickness being about 50 to 150 μm. These porous layers are about 50% of theoretical density and sufficiently sintered at temperatures of about 750° C. to about 1000° C. in an inert or reducing atmosphere, for example, for at least about 10 minutes at 750° C. and at least about 2 to 3 minutes at 1000° C. so as to exhibit an optimum combination of strength and electrochemical characteristics. Strength in the porous layer is necessary in order to resist cavitation forces existing at a water electrolyzer anode surface during high current density operation. Porosity is necessary in order that the overpotential remain as low as practical. An optimum combination of these characteristics is attained during sintering nickel 123 powder* onto steel approximately at the time when spiky protrusions on the individual powder particles disappear but the angularity of the individual powder particles is still evident under microscopic examination. This state of sintering is achieved with nickel 123 powder on steel usually within a few minutes after meeting the minimum sintering times set forth hereinbefore. A different grade of nickel powder produced by decomposition of nickel carbonyl and sold by INCO, Ltd. as nickel 287 powder, nickel-iron powder made by co-decomposition of nickel carbonyl and iron carbonyl and flake made by milling 123 powder have also been found satisfactory for manufacture of anodes of the present invention.

*a product of INCO, Ltd. made by thermal decomposition of nickel carbonyl, the manufacture of which is generally described in one or more of patents Can. Pat. No. 921,263, U.K. Pat. No. 1,062,580, U.K. Pat. No. 741,943.

The sintered layer on an anode support surface in accordance with the present invention should consist of a metallurgically bonded mass of powder the individual particles of which are in the size range (or equivalent spherical size* range) of about 2 to about 30 μm. The preferred layers are of the order of about 15 to 20 particles thick and contain tortuous paths of varying dimension principally dependent upon the size and degree of packing of the individual powder particles.

*Equivalent spherical size range (for purposes of this specification and claims equal to size range) is employed with flake powder and indicates the size range of spherical powder particles having volumes equal to the volumes of the flake (or flake-like) powder particles.

Andoe (as well as cathode) precursor structures of the present invention can be formed on steel or other metal bases using slurry coating compositions and techniques as set out in one or more of Parikh et al. U.S. Pat.

No. 3,310,870, Flint et al. U.S. Pat. No. 3,316,625 and Jackson et al. U.S. Pat. No. 3,989,863, as well as, by other slurry coating techniques, electrostatic spray, cloud and fluid bed processes and any other means whereby a thin layer of fine metal powder can be applied in a controllable, non-mechanically packed manner to a metal substrate. Prior to coating with metal powder, the substrate metal surface is advantageously roughened such as by sandblasting, grit blasting or the like. After coating the substrate is dried (if a liquid carrier of the metal powder has been used) and sintered as disclosed hereinbefore to metallurgically bond particles one to another and to the base by diffusion. During sintering it is necessary to maintain a reducing or inert atmosphere in the vicinity of the sintering layer in order to avoid thermal oxidation. If such thermal oxidation to produce an electrically non-conductive oxide occurs, it is necessary to reduce this oxide to metal prior to using the anode precursor as a water-electrolyzer anode.

ANODE EXAMPLES

Anode precursor panels were made by coating grit blasted mild steel (1008 grade) substrates with metal powder dispersed in a polysilicate aqueous vehicle (as disclosed by Jackson et al. in U.S. Pat. No. 3,989,863). The substrates were dried and then sintered in a cracked ammonia atmosphere. Details of the panel preparation are set forth in Table I.

TABLE I

| PANEL NO. | COATING MATERIAL | THICKNESS, μm | SINTERING: TIME, min. | SINTERING: TEMP, °C. |
|---|---|---|---|---|
| 1 | Ni 123 | 112 | 60 | 760 |
| 2 | Ni 123 | 89 | 10 | 760 |
| 3 | Ni 287 | 287 | 60 | 760 |
| 4 | Ni 287 | 20 | 60 | 760 |
| 5 | Atomized Ni | 80 | 10 | 980 |
| 6 | Ni flake | 84 | 60 | 760 |
| 7 | NiFe | 107 | 60 | 760 |

The anode precursors panels identified in Table 1 were then tested as anodes for short times in 80° C. aqueous KOH (30% by weight) electrolyte at various anode current densities using a planar nickel cathode. Overpotential was measured against a saturated calomel electrode (SCE) using a standard method. Details of the testing and results thereof are set forth in Table II.

TABLE II

| Panel No. | $O_2$ OVERPOTENTIAL, V AT (mA/cm$^2$) 1 | 10 | 100 | 200 | 400 |
|---|---|---|---|---|---|
| 1 | .14 | .18 | .22 | .23 | .26 |
| 2 | .14 | .18 | .22 | .25 | .27 |
| 3 | .14 | .18 | .22 | .23 | .26 |
| 4 | .16 | .20 | .23 | .25 | .27 |
| 5 | .16 | .20 | .23 | .25 | .28 |
| 6 | .16 | .19 | .23 | .25 | .29 |
| 7 | .17 | .20 | .25 | .27 | .29 |

Tables I and II together disclose the best mode of which applicants are aware for carrying out the anode aspect of the present invention. Other tests have shown that in many instances mild steel as a base is electrochemically advantageous as compared to nickel. Long term tests have shown no substantial corrosion of mild steel bases under laboratory anodic conditions approximating electrolyzer conditions. These results indicate the advantage of using cheap, mild steel substrates for electrolyzer anodes although, if desired, in accordance with the present invention other more expensive bases, such as nickel, nickel plated steel, nickel-iron alloys, etc. can be used. As those skilled in the art will recognize, the panel-type samples on metal about 0.5 to about 1.0 mm thick used to exemplify the electrodes of the present invention are merely exemplifying and not limiting. Electrode substrates (both anode and cathode) of the present invention can be sheet, wire, mesh, screen or any other form which the cell designer requires.

CATHODES

Cathodes of the present invention involve a precursor mechanically similar to the aforedescribed anode precursor and made in a similar manner. The cathode is characterized by having the metal continuum of the porous layer saturated or supersaturated with hydrogen. This saturation or supersaturation occurs substantially immediately or within a very short time after placing the cathode precursor in use in an electrolyzer. Table II sets forth details of cathode precursor structures of the present invention sintered or steel in the same manner as the anode precursors were made as described in conjunction with Table I.

TABLE III

| PANEL NO. | COATING MATERIAL | THICKNESS, μm | SINTERING: TIME, min. | SINTERING: TEMP, °C. |
|---|---|---|---|---|
| 8 | Ni 123 | 89 | 10 | 760 |
| 9 | Ni 123 | 57 | 10 | 870 |
| 10 | Ni 287 | 102 | 60 | 760 |
| 11 | Ni 287 | 287 | 60 | 760 |
| 12 | Atomized Ni | 80 | 10 | 980 |
| 13 | Ni flake | 84 | 60 | 760 |

Panels prepared as disclosed in Table III were employed as cathodes in 30% aqueous KOH at 80° C. with overpotential results as set forth in Table IV.

TABLE IV

| PANEL NO. | $H_2$ OVERPOTENTIAL, V AT (mA/cm$^2$) 1 | 10 | 100 | 200 | 400 |
|---|---|---|---|---|---|
| 8 | .10 | .23 | .35 | .38 | .42 |
| 9 | .11 | .25 | .37 | .40 | .42 |
| 10 | .06 | .24 | .36 | .40 | .41 |
| 11 | .05 | .20 | .30 | .32 | .35 |
| 12 | .10 | .17 | .30 | .35 | .40 |
| 13 | .07 | .23 | .36 | .41 | .43 |

The data in Table IV shows the utility of cathode structures of the present invention. The best mode of cathode structures in accordance with the present invention is deemed to be structures made as set forth in Table III but using iron powder plus carbon or steel powder (about 0.1% to 0.3% carbon, balance iron) as the powder sintered on a mild steel substrate.

FIGS. 1 and 2 of the drawing show, respectively, the structures of anodes and cathodes of the present invention as they appear under the scanning electron microscope at a magnification of 1000 power.

While the present invention has been described in conjunction with specific embodiments, those of normal skill in the art will appreciate that modifications and variations can be made without departing from the ambit of the present invention. Such modifications and variations are envisioned to be within the scope of the claims.

We claim:

1. An electrode for water electrolyzers comprising an electrically conductive support surface having a porous metallurgically bonded layer of metal about 50 to 150 μm thick comprised of particles from the group of nickel, nickel-iron alloys, iron and iron-carbon alloys said particles being in the size range of about 2 to 30 μm and being sintered together to a theoretical density of about 50% in such manner as to retain individual particle appearance while being adhered to at least part of said support surface, said porous metallurgically bonded layer comprising nickel and nickel-iron alloys containing at least 10% nickel and having a hydrated, electrochemically formed layer of oxide, incorporating metal of said metallurgically bonded layer on the external and internal surfaces of said porous layer when said electrode is an anode and said porous metallurgically bonded layer being saturated with hydrogen when said electrode is a cathode.

2. An anode as in claim 1 wherein said electrically conductive support surface is a mild steel.

3. An anode as in claim 1 wherein the porous, metallurgically bonded layer is a nickel layer which is sintered to a mild steel base.

4. An anode as in claim 1 wherein the porous metallurgically bonded layer is a nickel-iron alloy layer sintered to a mild base.

5. A cathode as in claim 1 wherein the metal of said metallurgically bonded layer is mild steel.

* * * * *